US007056190B2

(12) United States Patent
Lee

(10) Patent No.: US 7,056,190 B2
(45) Date of Patent: Jun. 6, 2006

(54) PAD CONDITIONER TEST APPARATUS AND METHOD

(75) Inventor: Sung-Choul Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/230,555

(22) Filed: Sep. 21, 2005

(65) Prior Publication Data

US 2006/0094337 A1 May 4, 2006

(30) Foreign Application Priority Data

Oct. 28, 2004 (KR) ..... 10-2004-0086872

(51) Int. Cl.
*B24B 49/18* (2006.01)

(52) U.S. Cl. ..... 451/5; 451/8; 451/11

(58) Field of Classification Search ..... 451/5, 451/8, 11, 21, 24, 56, 443, 444
See application file for complete search history.

(56) References Cited

U.S. PATENT DOCUMENTS

| | | | | |
|---|---|---|---|---|
| 6,695,680 | B1 * | 2/2004 | Choi et al. | 451/5 |
| 6,722,948 | B1 | 4/2004 | Berman | |
| 2004/0089070 | A1 * | 5/2004 | Elledge | 73/579 |

FOREIGN PATENT DOCUMENTS

| | | |
|---|---|---|
| JP | 2001-129754 | 5/2001 |
| KR | 1020030004491 A | 1/2003 |

* cited by examiner

*Primary Examiner*—Jacob K. Ackun, Jr.
(74) *Attorney, Agent, or Firm*—Volentine Francos & Whitt, PLLC

(57) ABSTRACT

A test apparatus and method tests a pad conditioner of a chemical mechanical polishing apparatus. The pad conditioner test apparatus includes a main body having a conditioner mounting section that supports the pad conditioner, a conditioner head raising/lowering system that raises and lowers the head of the pad conditioner while the pad conditioner is supported on the test apparatus, and a discrimination section that detects the ability of the head to be raised/lowered in accordance with a program so that the condition of the head can be determined. The test apparatus can prevent various problems that otherwise would occur if a new pad conditioner were directly installed in the chemical mechanical polishing apparatus.

21 Claims, 7 Drawing Sheets

PAD CONDITIONER TEST APPARATUS AND METHOD

BACKGROUND OF THE INVENTION

1. Field of the Invention

The present invention relates to an apparatus for and a method of testing a pad conditioner of a chemical mechanical polishing (CMP) apparatus.

2. Description of the Related Art

Today's semiconductor devices have densely integrated multi-layered structures. Therefore, it is essential for the manufacturing of a semiconductor device to include a polishing process for planarizing layers formed on a semiconductor wafer. The polishing process typically employs CMP (chemical mechanical polishing). Moreover, CMP can produce excellent flatness over a wide region as well as a narrow region. Therefore, the current trend is to use CMP as the process for polishing large-diameter wafers.

More specifically, in the CMP process, a tungsten or oxide layer on a wafer is polished simultaneously by mechanical friction and by a chemical reaction. The mechanical polishing is effected by holding the wafer with suction to a polishing head, bringing the wafer into contact with a polishing pad, and rotating the polishing head so that the surface of the wafer is polished by friction between the polishing pad and the surface of the wafer. The chemical polishing is effected by supplying a chemical slurry between the polishing pad and the wafer.

In addition, the condition of the surface of the polishing pad of the CMP apparatus is an important factor affecting such characteristics as the uniformity and flatness of the polished surface of a wafer. Therefore, the condition of the surface of the polishing pad must be maintained in its initial state if the planarization process is to be most effective. However, the polishing pad may be damaged due to abrasives or foreign substances becoming jammed between the polishing pad and the wafer during the polishing process. In this case, the surface of the polishing pad deteriorates such that the efficacy of the planarization process is reduced.

Therefore, various kinds of pad conditioners and methods of using the pad conditioners to maintain the surface condition of the polishing pad have been proposed. The pad conditioners include a circular plate formed of an alloy of nickel and iron, and diamond particles attached to the circular plate. A generally known pad conditioning method is to entirely and uniformly abrade the surface of the polishing pad by scrubbing it with the pad conditioner.

FIG. 1 illustrates an example of a conventional CMP apparatus. The conventional CMP apparatus 20 includes a polishing table (not shown) that rotates at a predetermined number of rpm's, a polishing pad 23 mounted on the upper surface of the polishing table for polishing a wafer 10, a polishing head 25 for holding the wafer 10 against the polishing pad 23, a pad conditioner 29 pivotably supported at one side of the polishing pad 23 and operative to score the polishing pad 23 such that the initial surface roughness of the polishing pad 23 is maintained, and a slurry supplier 27 for supplying an abrasive slurry onto the polishing pad 23. The polishing head 25 picks up a wafer 10 using suction. Then the polishing head 25 places the wafer against the polishing pad 23. The polishing pad 23 is rotated and slurry is dispensed onto the polishing pad by slurry supplier 27. The entire surface of the wafer 10 is thus uniformly polished by mechanical friction from contact with the polishing pad 23 and by a chemical reaction with the slurry.

FIG. 2 illustrates a conventional pad conditioner of a CMP apparatus. The conventional pad conditioner 29 includes a conditioner main body 290*b* and a cover 290*a* for covering the conditioner main body 290*b*. The conditioner main body 290*b* includes a mounting portion 291 by which the pad conditioner is mounted in the CMP apparatus 20, a head portion 294, and an arm portion 293 connecting the mounting portion 291 and the head portion 294.

More specifically, the mounting portion 291 includes a swing motor (not shown) for swinging the head portion 294 and the arm portion 293 about a vertical axis, a rotary motor (not shown) for rotating the head portion 294, a first pulley 292 engaged with the rotary motor, and a gas supply unit (not shown) for selectively providing gas into or withdrawing the gas from a gas supply hole 294*a*.

In addition, the head portion 294 of the pad conditioner 29 includes a polishing disk 295*a* made up of diamond particles that score the polishing pad 23, a conditioner head 295 (hereinafter referred to merely as a "head") to which the polishing disk 295*a* is held, a piston 298 fixed to an upper surface of the head 295, a head raising/lowering unit 296 provided with a diaphragm (not shown) for raising and lowering the head 295 and the piston 298 according to the pressure created in the gas supply hole 294*a* by the gas supply unit, and a second pulley 297 engaged with an upper portion of the head raising/lowering unit 296. The gas supply hole 294*a* extends through the center of the second pulley 297 so as to be in fluid communication with the diaphragm.

In addition, the arm portion 293 has a timing belt 299 connecting the first pulley 292 and the second pulley 297.

The conventional pad conditioner 29 operates as follows.

When the polishing pad 23 is to be conditioned, an operator turns on the swing motor and the rotary motor together with the gas supply unit to supply gas into the gas supply hole 294*a*. As a result, the head portion 294 and the arm portion 293 are swung back and forth about the mounting portion 291 by the swing motor, and the head 295 is rotated by the rotary motor via the pulleys 292 and 297 and the belt 299. At the same time, the pressure of the gas supplied by the gas supply unit expands the diaphragm to thereby lower the head 295 into contact with the polishing pad 23. Thus, the polishing pad 23 is scored by the polishing disk 295*a*.

Then, when the conditioning operation is to be terminated, the operator turns off the swing motor and the rotary motor and simultaneously operates the gas supply unit to evacuate the gas supply hole 294*a*. As a result, the head portion 294 stops oscillating, the head 295 stops rotating and, at the same time, the head 295 is raised by the contraction of the diaphragm resulting from the negative pressure (vacuum) created in the gas supply hole 294*a*. Therefore, the polishing pad 23 and the head 295 are separated from each other. The conditioning operation of the polishing pad 23 is repeated by the operator over the course of one or more polishing processes.

However, the diaphragm of the pad conditioner 29 is made of rubber. Therefore, the diaphragm can fail or develop a leak after a period of extended use of the pad conditioner such that the head 295 can not be smoothly raised and lowered can not be raised and lowered at all.

Thus, the head portion 294 including the diaphragm is periodically disassembled and replaced to avoid such problems. That is, preliminary maintenance (PM) is performed. However, even then the head portion 294 including the diaphragm may operate so roughly that the rate at which material is removed during the CMP process decreases, thereby lowering the efficiency of the CMP process, creating frequent EPD (end point detection) errors, and necessitating more frequent PM.

SUMMARY OF THE INVENTION

An object of the present invention is to prevent problems that may occur when a head portion of a pad conditioner is directly installed in the CMP apparatus.

More specifically, an object of the present invention is to provide an apparatus for and a method of testing in advance whether a pad conditioner is in good condition.

According to one aspect of the present invention, a pad conditioner test apparatus includes a main body having a conditioner mounting section to which a pad conditioner is mounted, conditioner head raising/lowering means for raising and lowering the head of the pad conditioner, and discrimination means for detecting a state of the raising/lowering of the head to determine whether the head is in good condition.

The discrimination means may include a sensor positioned to detect the movement of the head, and a controller for determining whether the head is in good condition depending on the output of the sensor. Preferably, the sensor is a proximity sensor provided on the main body opposite a bottom surface of the head.

The conditioner head raising/lowering means may include a connecting pipe connectable to the pad conditioner, a gas supply unit connected to the connecting pipe to supply gas to the connecting pipe to lower the head, and a vacuum unit connected to the connecting pipe to create negative (vacuum) pressure that raises the head.

The push gas supply unit may, in turn, include a source of (compressed) gas, a gas supply pipe connecting the source of gas and the connecting pipe, and a flow control (on/off) valve disposed in the gas supply pipe. In addition, a gas regulator may be connected to the gas supply pipe for adjusting the flow rate of the gas supplied to the connecting pipe.

The vacuum unit may, in turn, include a vacuum generator, a vacuum pipe connecting the vacuum generator and the connecting pipe, and a flow control (on/off) valve disposed in the vacuum pipe. In addition, a regulator may be connected to the vacuum pipe for adjusting the level of the negative pressure created in the connecting pipe.

Furthermore, the conditioner head raising/lowering means may further include a valve unit including at lest one valve for selectively placing the gas supply unit and the vacuum unit in communication with the connecting pipe. Preferably, the valve unit includes a three-way valve having a first orifice connected to the connecting pipe, a second orifice connected to the push gas supply pipe, and a third orifice connected to the vacuum pipe.

The test apparatus may also include an operation section by which the conditioner head raising/lowering means is operated. The operation section may include a gas regulation switch that can be manipulated to adjust the flow rate of the gas supplied to the head, a vacuum regulation switch that can be manipulated to adjust the level of negative pressure created in the head, and a button unit by which the number of raising/lowering operations of the head can be pre-set.

In addition, the operation section may include a gas gauge for indicating the flow rate of the gas supplied to the head, and a vacuum gauge for indicating the level of negative pressure existing in the head.

Furthermore, the operation section may include lights for indicating whether the pad conditioner is in good condition, and a display for displaying details on the condition of the pad conditioner when the pad conditioner is not in good condition.

According to another aspect of the invention, a pad conditioner of a CMP appratus is tested by mounting the pad conditioner to a test apparatus with the head of the pad conditioner being free to move along its axis, actuating the head to move the head of the pad conditioner back and forth along the axis (raise/lower the head), detecting the movement of the head along the axis and generating signals indicative of the movement, and determining whether the head is in a good condition on the basis of the signals.

The head of the pad conditioner may be actuated by selectively supplying gas to opposite sides of the head, for instance. The head of the pad conditioner may also be actuated by selectively supplying gas to and creating negative pressure in the pad conditioner.

In addition, the movement of the head may be detected by sensing the number of times the head arrives at a given postion along its axis. In this case, the condition of the head can be determined by pre-setting the number of times the head is to be actuated to move the head back and forth along the axis, and comparing the set number of times the head is actuated and the detected number of of times the head actually arrives at the given postion.

Furthermore, the method may further include displaying the state of the head at the exterior of the test apparatus.

BRIEF DESCRIPTION OF THE DRAWINGS

The foregoing and other objects, features and advantages of the invention will be more apparent from the detailed description of the preferred embodiments of the invention, as illustrated in the accompanying drawings. The drawings are not necessarily to scale, emphasis instead being placed upon illustrating the principles of the invention. In the drawings.

DETAILED DESCRPTION OF THE PREFERRED EMBODIMENTS

Figure 1:
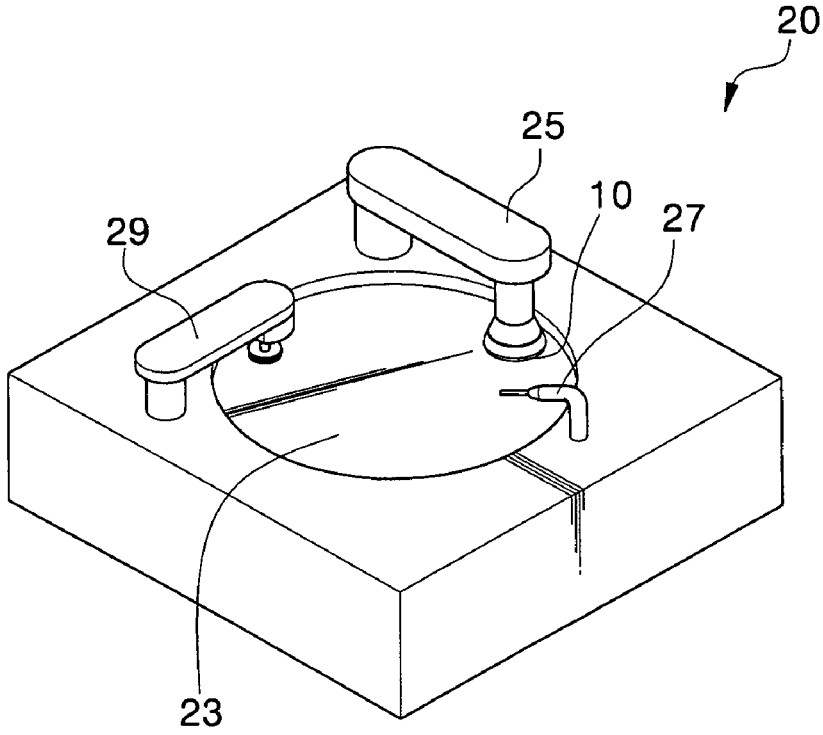
FIG. 1 is a perspective view of a conventional chemical mechanical polishing apparatus.
Figure 2:
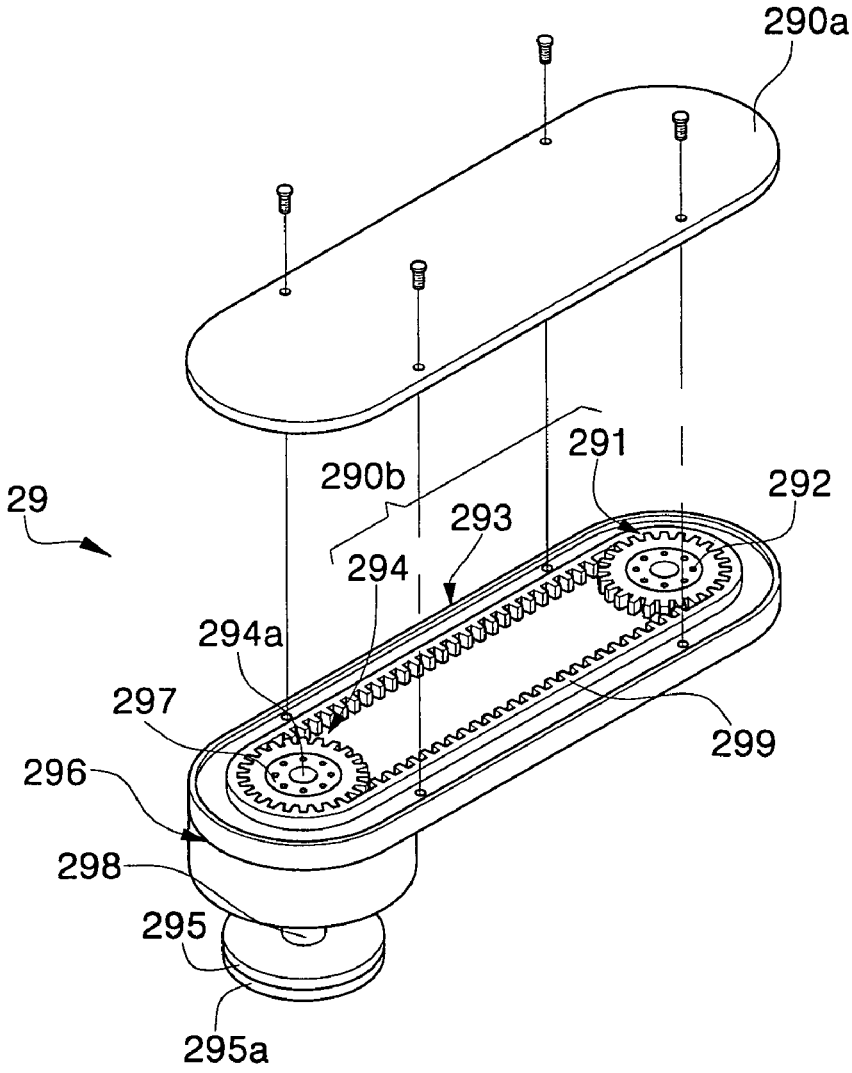
FIG. 2 is an exploded perspective view of a pad conditioner of the polishing apparatus shown in FIG. 1.

The present invention will now be described more fully with reference to the FIGS. 3–6, in which the preferred embodiments of the invention are shown. Note, the same reference numerals are used to denote the same elements throughout the drawings.

Figure 3:
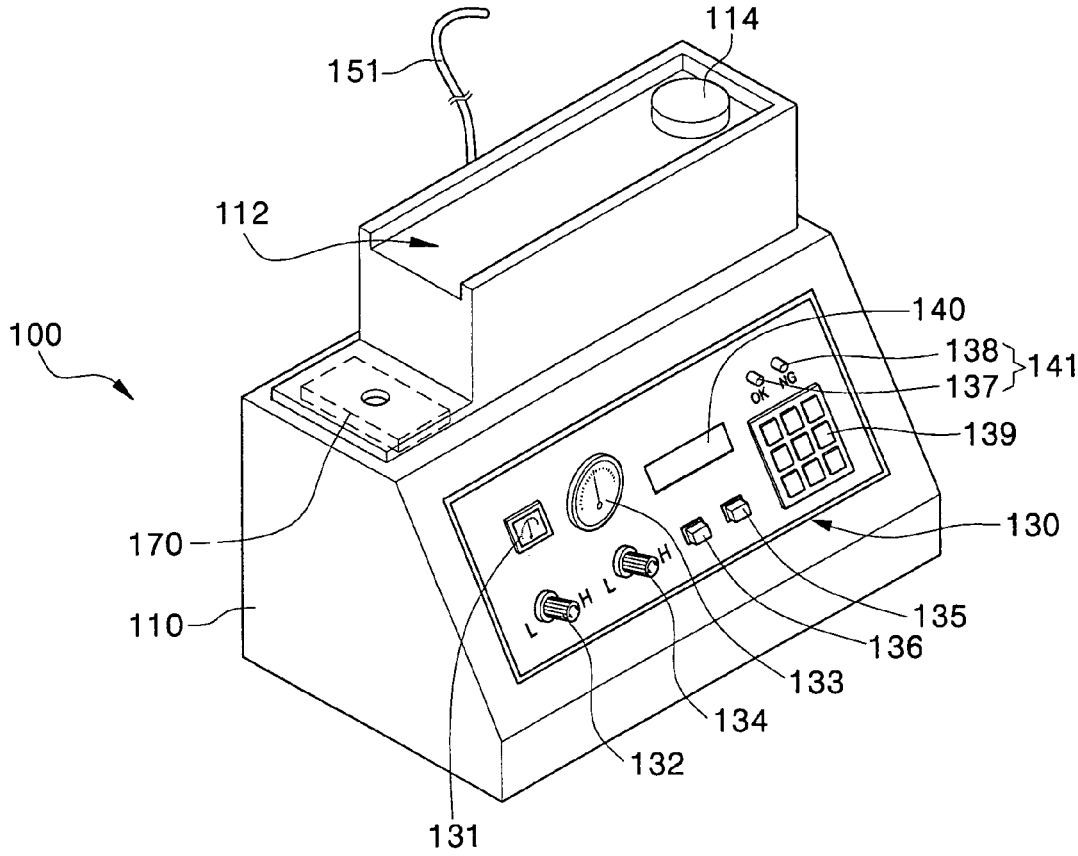
FIG. 3 is a perspective view of a pad conditioner test apparatus in accordance with the present invention.
Figure 4:
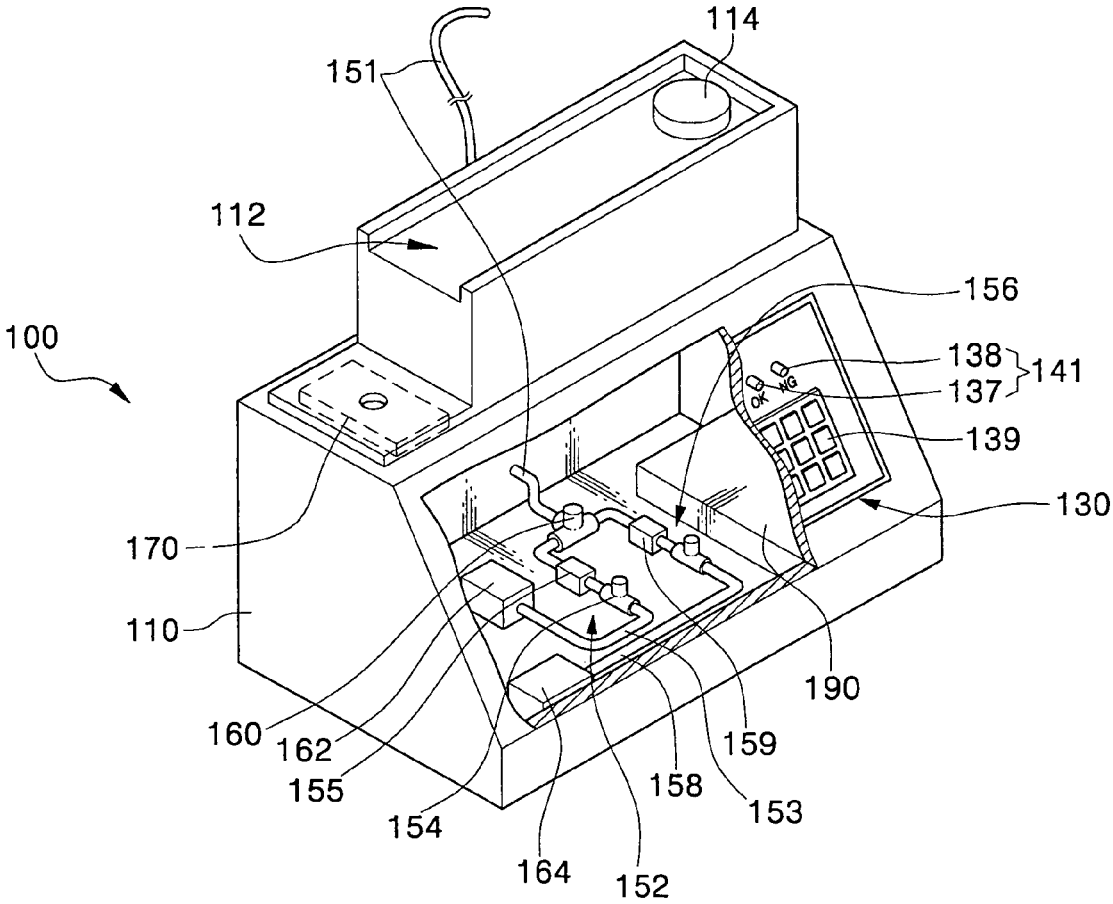
FIG. 4 is a partially broken-away perspective view of the test apparatus of FIG. 3.
Figure 5:
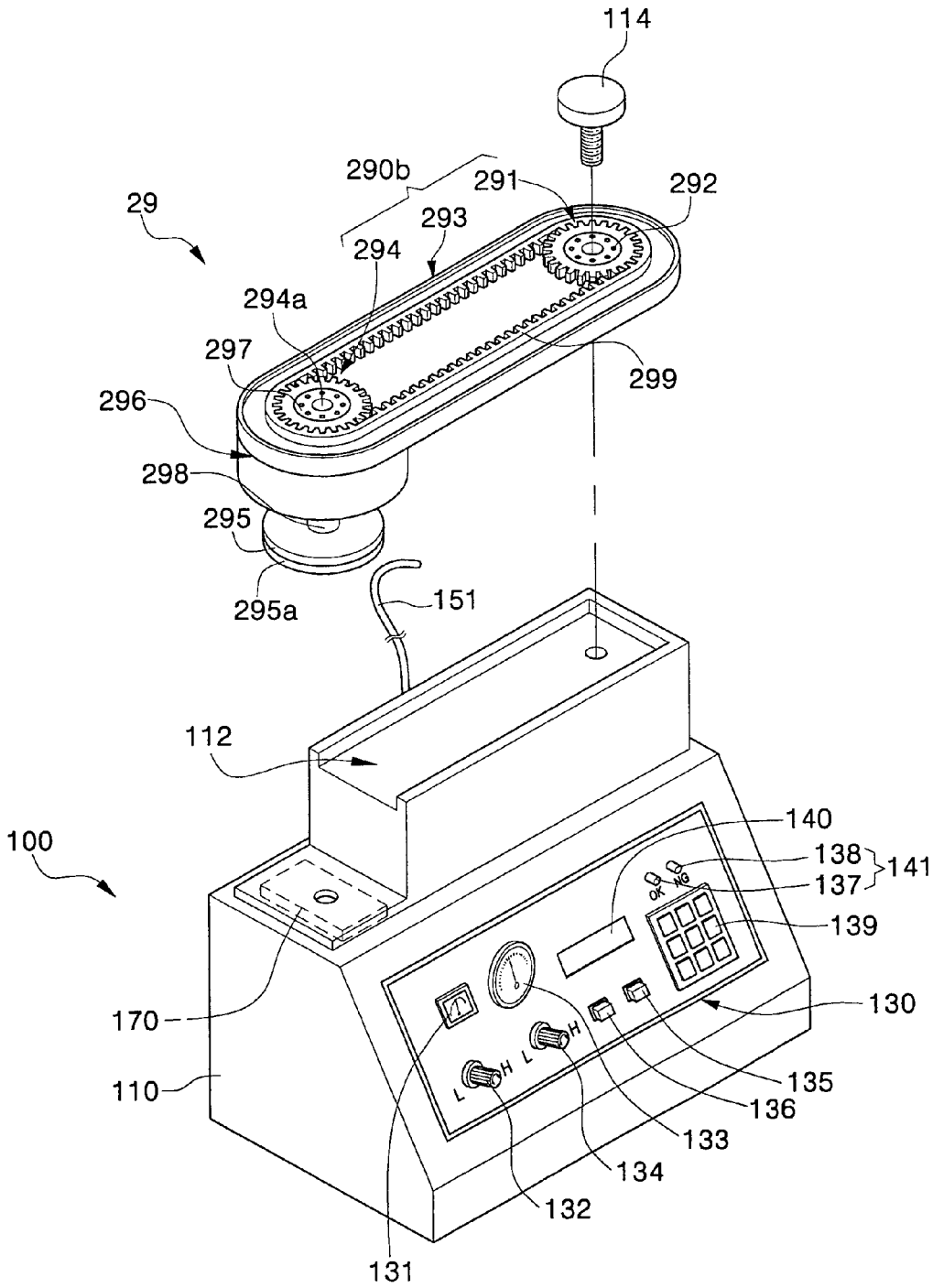
FIG. 5 is a perspective assembly view of a test apparatus and a pad conditioner mounted thereon in accordance with the present invention.
Figure 6:
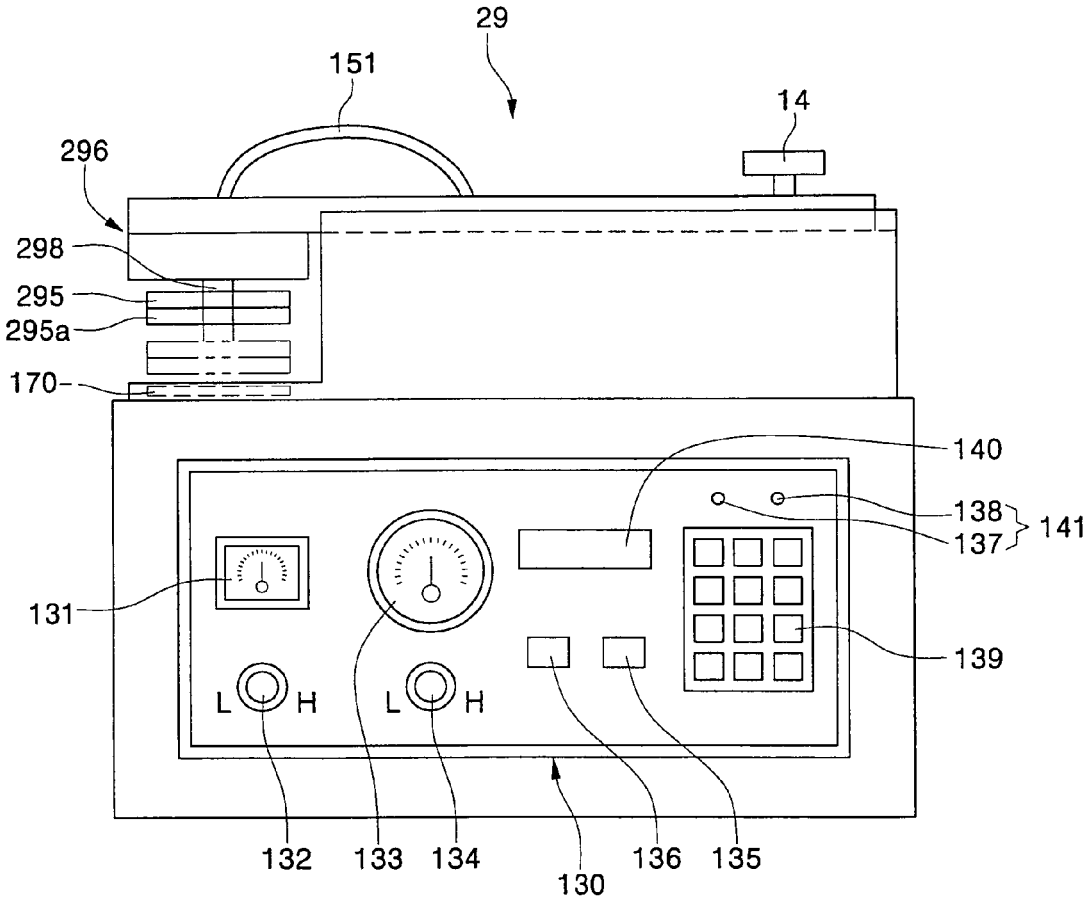
FIG. 6 is a front view of a test apparatus with a pad conditioner mounted thereon in accordance with the present invention.
Figure 7:
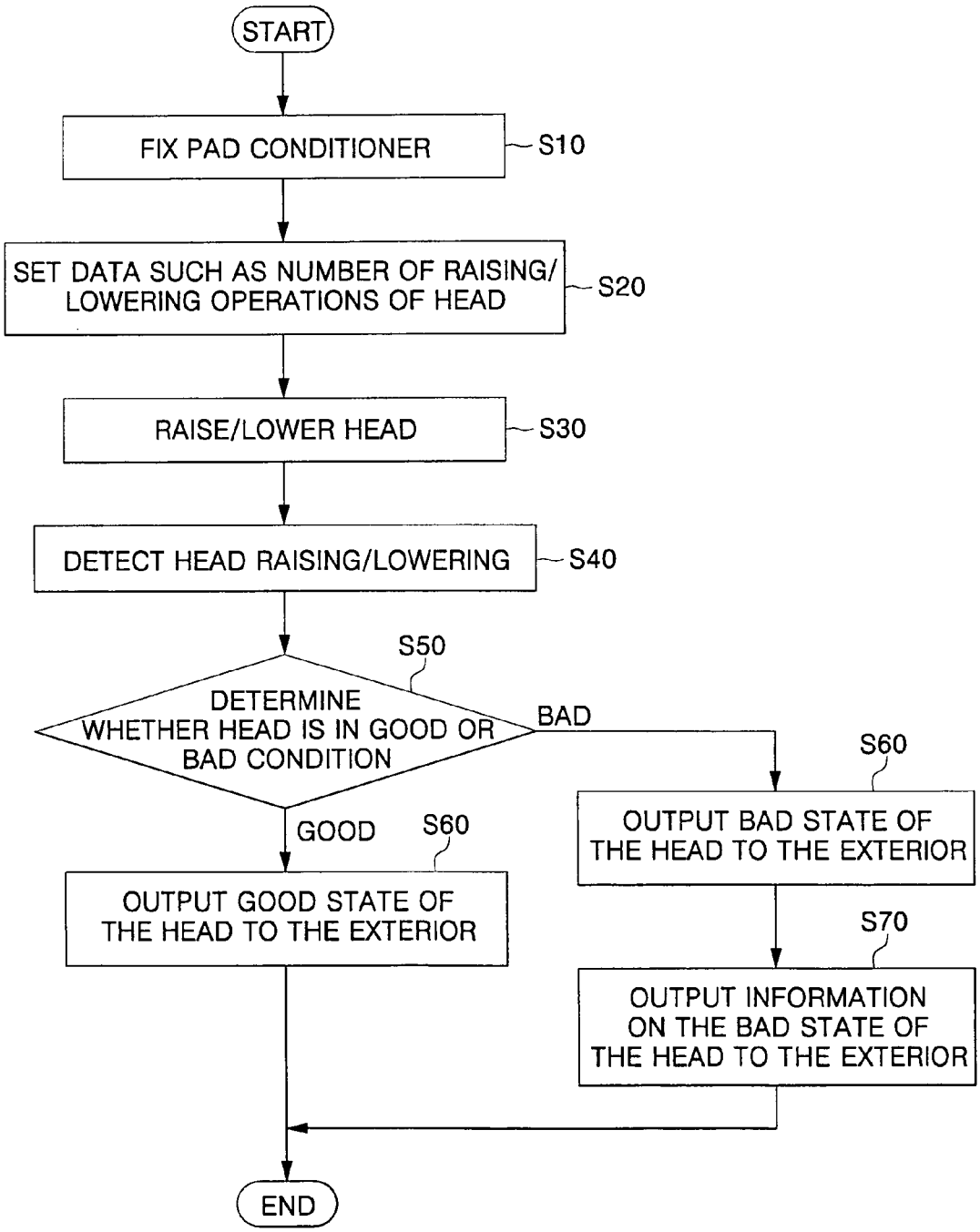
FIG. 7 is a flowchart illustrating a method of testing a pad conditioner test apparatus in accordance with the present invention.

Referring first to FIGS. 3–5, the pad conditioner test apparatus 100 according to the present invention includes: a main body 110 having a conditioner mounting section 112 for supporting a pad conditioner 29, a conditioner head raising/lowering means for raising and lowering a head 295 of the pad conditioner 29, a discrimination section for determining whether the head 295 is in good condition, and an operation section provided at the exterior of the main body 110 to operate the conditioner head raising/lowering means.

More specifically, the main body 110 has the basic form of a box, and the conditioner mounting section 112 is disposed on the main body 110. As best shown in FIGS. 3 and 5, the conditioner mounting section 112 is stepped so as to have an upper part and a lower part. The upper part of the conditioner mounting section 112 supports an arm portion 293 and a mounting portion 292 of the pad conditioner 29. On the other hand, the head portion 294 of the pad conditioner 29 is disposed above the lower part of the conditioner mounting section 112 so as to be exposed. In addition, the conditioner mounting section 112 is provided with a fastener 114 for fixing the pad conditioner 29 to the upper part thereof. Therefore, only the head 295 of the pad conditioner 29 is raised/lowered when the pad conditioner 29 is tested, whereas the arm portion 293 and the fixing portion 291 do not move.

Referring now to FIGS. 4 and 5, the conditioner head raising/lowering means includes a connecting pipe 151 detachably connectable to a gas supply hole 294*a* of the pad conditioner 29, a gas supply unit 152 connected to the connecting pipe 151 to supply gas to the connecting pipe 151 to lower the head 295, a vacuum unit 156 connected to the connecting pipe 151 to create negative pressure in the connecting pipe 151 to raise the head 295, and a valve unit 160 connected to the connecting pipe 151 to selectively place the gas supply unit 152 and the vacuum unit 156 in communication with the connecting pipe 151. Alternatively, the conditioner head raising/lowering means may comprise other gas pressure control systems. For example, the conditioner head raising/lowering means may comprise an air cylinder or the like. As another alternative, the conditioner head raising/lowering means may include a first gas supply unit for supplying gas to one side of the head 295 to lower the head 295, and a second gas supply unit (not shown) for supplying gas to the other side of the head 295 to raise the head 295.

In the illustrated embodiment, the gas supply unit 152 includes a gas supply source 162 for supplying gas, a gas supply pipe 153 connecting the push gas supply source 162 and the connecting pipe 151 such that gas from the gas supply source 162 can be fed to the connecting pipe 151, a valve 154 disposed in the push gas supply pipe 153 to selectively allow and block the flow of gas through the gas supply pipe 153, and a gas regulator 155 installed in the push gas supply pipe 153 to adjust the rate at which the push gas flows through the connecting pipe 151. Preferably, the gas includes $N_2$. In this case, the gas supply source 162 may be the $N_2$ gas supply (not shown) that is typically installed in a semiconductor manufacturing line to supply $N_2$ gas to various semiconductor manufacturing apparatuses of the line.

The vacuum unit 156 includes a vacuum generator 164 for generating a predetermined level of negative pressure, a vacuum pipe 157 connecting the vacuum generator 164 and the connecting pipe 151 such that the negative pressure generated by the vacuum generator 164 can suction gas from the connecting pipe 151, a valve 158 disposed in the vacuum pipe 157 to selectively allow the negative pressure to act and prevent the negative pressure from acting through the vacuum pipe 157, and a vacuum regulator 159 installed in the vacuum pipe 157 to regulate the level of (vacuum) pressure applied to the connecting pipe 151. Note, the vacuum generator 164 may be a vacuum pump typically installed in a semiconductor manufacturing line to create a predetermined level of negative pressure in the various semiconductor manufacturing apparatuses of the line.

The valve unit 160 may comprise any of various means capable of selectively placing the gas supply unit 152 and the vacuum unit 156 in communication with the connecting pipe 151. In one embodiment, the valve unit 160 may comprise a three-way valve having first, second and third orifices. In this case, preferably, the first orifice of the three-way valve is connected to the connecting pipe 151, the second orifice is connected to the gas supply pipe 153, and the third orifice is connected to the vacuum pipe 157.

The discrimination section includes head raising/lowering detection means for detecting the raised/lowered position of the head 295, and a controller 190. The controller 190 controls the pad conditioner apparatus 100, determines whether the head 295 is in good condition on the basis of a value of a signal output by the head raising/lowering detection means, and outputs a signal for displaying the result of the determination. More specifically, the head raising/lowering detection means may use a photo sensor or preferably, a proximity sensor 170 to detect whether the head 295 has been raised or lowered. When the head raising/lowering detection means comprises a proximity sensor 170, the proximity sensor 170 is preferably provided on the main body 110 opposite to a bottom surface of the head 295. The controller 190 compares raising/lowering data of the head 295 raising/lowering data of the head 295, previously stored in the controller 190, with raising/lowering data output by the head raising/lowering detection means. The controller 190 then determines whether the head 295 is in good condition depending on the comparison of the data, and outputs a signal indicative of the state of the head 295 to a lamp unit 141. An operator can recognize whether the head 295 is in good condition from the visual provided by the lamp unit 141.

The operation section includes a gas regulation switch 132 by which the rate at which gas is supplied to the head 295 can be adjusted, a vacuum regulation switch 134 by which the level of negative pressure acting on the diaphragm of the head 295 can be adjusted, and a button unit for by which a number of raising/lowering operations of the head 295 can be input to the controller 190. Therefore, the operator can control the conditioner head raising/lowering means to operate in a manual mode, an automatic mode, or a certain pattern, or to perform a certain cycle, using the regulation switches 132 and 134 and the button unit.

More specifically, the gas regulation switch 132 and the vacuum regulation switch 134 are connected to the controller 190. The controller 190 controls the valves 154 and 158 and regulators 155 and 159 of the conditioner head raising/lowering means in response to signals produced by the operator through his/her manipulation of the gas regulation switch 132 and the vacuum regulation switch 134. The button unit includes a plurality of push buttons and at least one keypad 139. The push buttons may include start/stop button(s) 135 for starting and stopping the test apparatus 100, and read/write button(s) 136 for selectively operating the test apparatus in a data writing mode or a data reading mode and displaying the modes, and so on. On the other hand, the keypad 139 functions to allow the raising/lowering data of the head 295 to be input to the controller 190, and allows the operator to manage other basic operations of the test process.

The operation section may further include a gas gauge 131 for measuring and displaying the flow rate of the gas supplied by the gas supply unit 152, a vacuum gauge 133 for measuring and displaying the negative pressure created by the vacuum unit 156, the lamp unit 141 for indicating whether the pad conditioner 29 is in good condition, and a display unit 140 for displaying information on the pad conditioner 29 when the pad conditioner 29 is in poor condition. Preferably, the lamp unit 141 includes an NG lamp 138 and an OK lamp 137 is capable of operating in a flickering mode, a turn on mode, and a turn off mode. In this case, the controller 190 turns on, turns off, or flickers the lamp unit 141 to indicate the condition (good or bad) of the head 295.

Hereinafter, a method of testing a pad conditioner test apparatus 100 in accordance with the present invention will be described in conjunction with FIGS. 3 to 7.

First, an operator places a pad conditioner 29 on the conditioner mounting section 112 of the pad conditioner test apparatus 100, and then fixes the pad conditioner 29 in place using the fastener 114 (S10). At this time, the head 295 of the pad conditioner 29 is free to move up and down along its respective (vertical) axis.

Then, the operator inputs data to the controller 190 of the test apparatus 100 using buttons 135 and 136 and the keypad 139 of the operation section (S20). For example, the operator inputs a number of raising/lowering operations of the head 295 to the controller 190, i.e., the number of times that the head 295 is to be actuated for purposes of testing.

Next, the operator uses the operation part to signal the controller 190 to actuate the head 295 (S30). As a result, the controller 190 controls the conditioner head raising/lowering means to selectively supply gas to and suction gas from the pad conditioner 29. Meanwhile, the head raising/lowering detection means, e.g. the proximity sensor 170, detects the number of times the head 295 has actually been raised and lowered by detecting each time the head 295 arrives at a given position proximate the sensor 170 (S40).

Once the conditioner head raising/lowering means has performed its operation intended to raise/lower the head 295 a predetermined number of times, the controller 190 compares this predetermined number (number of times the head was actuated) with the number of times the head 295 was actually raised/lowered as detected by the head raising/lowering detection means. The controller then determines whether the head 295 is in good condition using the results of the comparison (S50), and then outputs the results to a display unit 140 or a lamp unit 141 of the operation section (S60).

In an embodiment of the present invention, the controller 190 turns on an OK lamp 137 of the lamp unit 141 when the head 295 is in good condition, and turns off an NG lamp 138 of the lamp unit 141 when the head 295 is in poor condition. In addition, the controller 190 outputs information on the state of the head 295 to the display unit 140 when the head is in poor condition in (S70). Therefore, the operator can easily determine the condition of the pad conditioner 29. Thus, the operator installs the pad conditioner 29 in the CMP apparatus 100 when the test apparatus indicates that the head 295 of the pad conditioner is in good condition. On the other hand, the operator repairs or replaces the bad pad conditioner 29 when the test apparatus indicates that the head 295 is in poor condition. Therefore, it is possible to prevent the conventional problems that can occur when the condition of the head 295 degrades during a CMP process.

As can be seen from the foregoing, the pad conditioner test apparatus and method of in the present invention, in which the pad conditioner is tested before it is installed in the CMP apparatus, is capable of preventing various problems of the prior art. That is, the present invention can prevent an under-CMP phenomena and frequent EPD errors from occurring, and can obviate the need to repeatedly perform PM and so on.

Finally, although the present invention has been described in connection with the preferred embodiments thereof, it is to be understood that the invention is not so limited. Rather, the present invention may encompass various modifications of the disclosed embodiments with the true spirit and scope of the invention being defined by the appended claims.

What is claimed is:

1. A pad conditioner test apparatus for use in testing a pad conditioner of a chemical mechanical apparatus, the apparatus comprising:

a main body having a conditioner mounting section configured to support a pad conditioner of a chemical mechanical polishing apparatus with a head of the pad conditioner being free to move up and down relative to the main body;

conditioner head raising/lowering means, housed by the main body, for raising and lowering the head of a pad conditioner supported by the conditioner mounting section of the main body; and discrimination means for detecting the head of a pad conditioner supported by the conditioner mounting section of the main body as the head is raised and lowered by the conditioner head raising/lowering means, and for determining on the basis of the detecting whether the head is in a good condition.

2. The pad conditioner test apparatus according to claim 1, wherein the discrimination means comprises a sensor disposed on the main body so as to sense the presence of the head of the pad conditioner at a respective location in the test apparatus, and a controller connected to the sensor.

3. The pad conditioner test apparatus according to claim 2, wherein the sensor is a proximity sensor.

4. The pad conditioner test apparatus according to claim 1, wherein the conditioner head raising/lowering means comprises: a connecting pipe for connection to the pad conditioner, a gas supply unit including a source of gas connected to the connecting pipe such that gas from the source can be supplied to the connecting pipe, and a vacuum unit connected to the connecting pipe such that gas can be suctioned from the connecting pipe.

5. The pad conditioner test apparatus according to claim 4, wherein the gas supply unit further includes a gas supply pipe connecting the source of gas and the connecting pipe, and a flow control valve disposed in the gas supply pipe.

6. The pad conditioner test apparatus according to claim 5, wherein the gas supply unit further includes a gas regulator connected to the gas supply pipe such that the rate at which gas flows to the connecting pipe can be regulated.

7. The pad conditioner test apparatus according to claim 4, wherein the vacuum unit includes a vacuum generator operative to create negative pressure, a vacuum pipe connecting the vacuum generator and the connecting pipe such that negative pressure generated by the vacuum generator can be created in the connecting pipe, and a flow control valve disposed in the vacuum pipe.

8. The pad conditioner test apparatus according to claim 7, wherein the vacuum unit further includes a gas regulator connected to the vacuum pipe such that negative pressure created in the connecting pipe by the vacuum generator can be regulated.

9. The pad conditioner test apparatus according to claim 7, wherein the conditioner head raising/lowering means comprises a valve unit including at least one valve operative to selectively place the gas supply unit and the vacuum unit in communication with the connecting pipe.

10. The pad conditioner test apparatus according to claim 9, wherein the at least one valve of the valve unit is a three-way valve having a first orifice connected to the connecting pipe, a second orifice connected to the gas supply pipe, and a third orifice connected to the vacuum pipe.

11. The pad conditioner test apparatus according to claim 9, and further comprising operation means, disposed at the exterior of the main body, for operating the conditioner head raising/lowering means.

12. The pad conditioner test apparatus according to claim 11, wherein the operation means comprises a gas regulation switch that can be manipulated to adjust the rate at which gas will be supplied through connecting pipe when the gas supply unit is in communication with the connecting pipe, a vacuum regulation switch that can be manipulated to adjust the level of negative pressure that will be created in the connecting pipe when the vacuum unit is in communication with the connecting pipe, and a button unit connected to the controller and by which data and/or signals can be input to the controller.

13. The pad conditioner test apparatus according to claim 12, wherein the operation means further comprises a gas gauge connected to the connecting pipe so as to indicate the rate at which gas flows through the connecting pipe when the gas supply unit is in communication with the connecting pipe, and a vacuum gauge connected to the connecting pipe so as to indicate to level of negative pressure in the connecting pipe when the vacuum unit is in communication with the connecting pipe.

14. The pad conditioner test apparatus according to claim 1, wherein the conditioner mounting section of the apparatus includes a fastener by which the pad conditioner can be fixed to part of the conditioner mounting section.

15. A pad conditioner test apparatus for use in testing a pad conditioner of a chemical mechanical apparatus having a head that is pneumatically actuatable to move vertically along a respective axis, the test apparatus comprising:

a main body having a conditioner mounting section configured to support the pad conditioner with the head of the pad conditioner being free to move back and forth along said axis relative to the main body;

a gas pressure control system for connection to the pad conditioner supported on the conditioner mounting section of the main body, the gas pressure control system being operative to move the head along said axis relative to the main body to test the pad conditioner;

a sensor supported in the test apparatus to sense the movement of the head of the pad conditioner along said axis to a given position, the sensor being operative to output signals indicative of the number of times of head of the pad conditioner arrives at the given position during the test; and a controller operatively connected to the gas pressure control system so as to control the operation of the gas pressure control system, and to the sensor so as to receive the signals output by the sensor.

16. The pad conditioner test apparatus according to claim 15, wherein the gas pressure control system includes a gas supply unit including a source of gas.

17. The pad conditioner test apparatus according to claim 16, wherein the gas pressure control system further includes a vacuum generating unit.

18. A method of testing a pad conditioner of a chemical mechanical polishign apparatus, the pad conditioner having a head that is actuatable to move vertically along a respective axis, the method comprising:

mounting the pad conditioner to a test apparatus with the head of the pad conditioner being free to move along said axis;

while the pad conditoner is mounted the test apparatus, actuating the head to move the head of the pad conditioner back and forth along the axis;

detecting the movement of the head along the axis, and generating signals indicative of the movement; and determining whether the head is in a good condition on the basis of said signals.

19. The method according to claim 18, wherein the moving of the head of the pad conditioner comprises selectively supplying gas to the pad conditioner.

20. The method according to claim 18, wherein the detecting of the movement of the head comprises sensing the number of times the head arrives at a given postion.

21. The method according to claim 20, wherein the determining whether the head is in a good condition comprises pre-setting the number of times the head is to be actuated to move the head back and forth along the axis, and comparing the set number of times the head is actuated and the detected number of of times the head arrives at the given postion.

* * * * *